US009790803B2

(12) United States Patent
Anderson et al.

(10) Patent No.: US 9,790,803 B2
(45) Date of Patent: Oct. 17, 2017

(54) DOUBLE SPLIT BLADE LOCK RING

(71) Applicant: United Technologies Corporation, Hartford, CT (US)

(72) Inventors: Carney R. Anderson, East Haddam, CT (US); Peter V. Tomeo, Middletown, CT (US)

(73) Assignee: United Technologies Corporation, Farmington, CT (US)

( * ) Notice: Subject to any disclaimer, the term of this patent is extended or adjusted under 35 U.S.C. 154(b) by 756 days.

(21) Appl. No.: 14/185,962

(22) Filed: Feb. 21, 2014

(65) Prior Publication Data

US 2014/0255196 A1 Sep. 11, 2014

Related U.S. Application Data

(60) Provisional application No. 61/774,743, filed on Mar. 8, 2013.

(51) Int. Cl.
*F01D 5/32* (2006.01)
*F01D 5/30* (2006.01)

(52) U.S. Cl.
CPC ..... *F01D 5/326* (2013.01); *F01D 5/3015* (2013.01); *Y10T 29/49321* (2015.01)

(58) Field of Classification Search
CPC ..... F01D 5/326; F01D 5/3015
USPC ..... 416/220 R, 221
See application file for complete search history.

(56) References Cited

U.S. PATENT DOCUMENTS

| | | | | |
|---|---|---|---|---|
| 4,187,056 | A | 2/1980 | Schwinn et al. | |
| 4,730,983 | A | 3/1988 | Naudet et al. | |
| 4,872,810 | A | 10/1989 | Brown et al. | |
| 6,533,550 | B1 | 3/2003 | Mills | |
| 6,846,159 | B2 * | 1/2005 | Zabawa | F01D 21/04 416/193 A |
| 7,244,105 | B2 | 7/2007 | Moeller | |
| 7,290,988 | B2 * | 11/2007 | Boston | F01D 5/3015 416/220 R |
| 7,806,662 | B2 | 10/2010 | Gekht et al. | |
| 8,459,954 | B2 * | 6/2013 | Anderson | F01D 5/3015 29/889.21 |
| 2009/0053064 | A1 | 2/2009 | Ress, Jr. | |
| 2011/0123341 | A1 * | 5/2011 | Aubin | F01D 5/3015 416/220 R |

* cited by examiner

*Primary Examiner* — Jermie Cozart
(74) *Attorney, Agent, or Firm* — Carlson, Gaskey & Olds, P.C.

(57) ABSTRACT

A rotor assembly for a gas turbine engine includes a plurality of blades including a root portion and an airfoil portion. The rotor includes a plurality of slots that receive the root portion of a corresponding blade. The rotor includes an annular groove for a first and second retaining ring. The retaining rings are received within a common annular groove for holding each of the plurality of blades within the slots of the rotor.

13 Claims, 5 Drawing Sheets

DOUBLE SPLIT BLADE LOCK RING

CROSS REFERENCE TO RELATED APPLICATION

This application claims priority to U.S. Provisional Application No. 61/774,743 which was filed on Mar. 8, 2013.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The fan section typically includes a plurality of fan blades that are supported within slots formed in a hub or rotating disk. The fan blades retained within the slots by a split ring. The split ring must be of sufficient stiffness to provide the desired retention. Disadvantageously, as fan sections grow larger, the stiffness of the retaining ring is also required to increase. Increases in required retaining ring stiffness can result in assembly difficulties.

Accordingly, it is desirable to develop a fan blade retention configuration that eases assembly while maintaining required retention strength.

SUMMARY

A rotor assembly according to an exemplary embodiment of this disclosure, among other possible things includes a plurality of blades including a root portion and an airfoil portion. A rotor includes a plurality of slots for receiving the root portion of the plurality of blades. The rotor includes an annular groove. A first retaining ring is received within the annular groove. A second retaining ring is received within the annular groove against the first retaining ring.

In a further embodiment of the foregoing rotor assembly, the first retaining ring is disposed aft of the second retaining ring in the same annular groove.

In a further embodiment of any of the foregoing rotor assemblies, the first retaining ring includes a first thickness. The second retaining ring includes a second thickness. The annular groove includes a width equal to or greater than the first thickness and the second thickness.

In a further embodiment of any of the foregoing rotor assemblies, the rotor includes a rotor alignment slot and each of the first and second retaining rings include alignment slots for setting a circumferential orientation of the first and second retaining rings relative to the rotor.

In a further embodiment of any of the foregoing rotor assemblies, includes a retaining pin received within the rotor alignment slot and the alignment slots defined within the first and second retaining rings for holding the retaining rings in the annular orientation.

In a further embodiment of any of the foregoing rotor assemblies, the first and second retaining rings extend through the slots for receiving the plurality of roots.

In a further embodiment of any of the foregoing rotor assemblies, the rotor includes a compressor rotor and the blades include compressor blades.

In a further embodiment of any of the foregoing rotor assemblies, the rotor includes a fan hub and the blades include fan blades.

A gas turbine engine according to an exemplary embodiment of this disclosure, among other possible things includes a rotor rotatable about an engine axis. The rotor includes a plurality of hooks defining slots for supporting blades on the rotor and an annular groove defined within the plurality of hooks. A first retaining ring is received within the annular groove. A second retaining ring is received within the annular groove and abutted against the first retaining ring.

In a further embodiment of the foregoing gas turbine engine, includes a plurality of blades received within the slots defined by the hooks. Each of the plurality of blades include a groove for receiving a portion of the first and second retaining rings.

In a further embodiment of any of the foregoing gas turbine engines, includes an alignment slot transverse to the groove for circumferentially aligning the first and second retaining rings.

In a further embodiment of any of the foregoing gas turbine engines, includes a retaining pin received within the alignment slot for holding the first and second retaining rings.

In a further embodiment of any of the foregoing gas turbine engines, the first retaining ring includes a first thickness and the second retaining ring includes a second thickness and the annular groove includes a width equal to or greater than the sum of the first thickness and the second thickness.

In a further embodiment of any of the foregoing gas turbine engines, the rotor includes a compressor rotor and the blades include compressor blades.

In a further embodiment of any of the foregoing gas turbine engines, the rotor includes a fan hub and the blades include fan blades.

A method of securing a blade within a rotor according to an exemplary embodiment of this disclosure, among other possible things includes defining an annular groove proximate a slot for receiving a blade root within a rotor, installing a first retaining ring into the annular groove, the first retaining ring includes a first thickness that is less than a width of the annular groove, and installing a second retaining ring next to the first retaining ring into the annular groove, the second retaining ring including a second thickness filling the remaining width of the annular groove.

In a further embodiment of the foregoing method, includes aligning a first slot in the first retaining ring with an alignment slot in the rotor and aligning a second slot of the second retaining ring with the first slot and the alignment slot.

In a further embodiment of any of the foregoing methods, includes inserting a pin within the alignment slot, first slot and second slot for maintaining the relative orientation between the first and second retaining rings.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
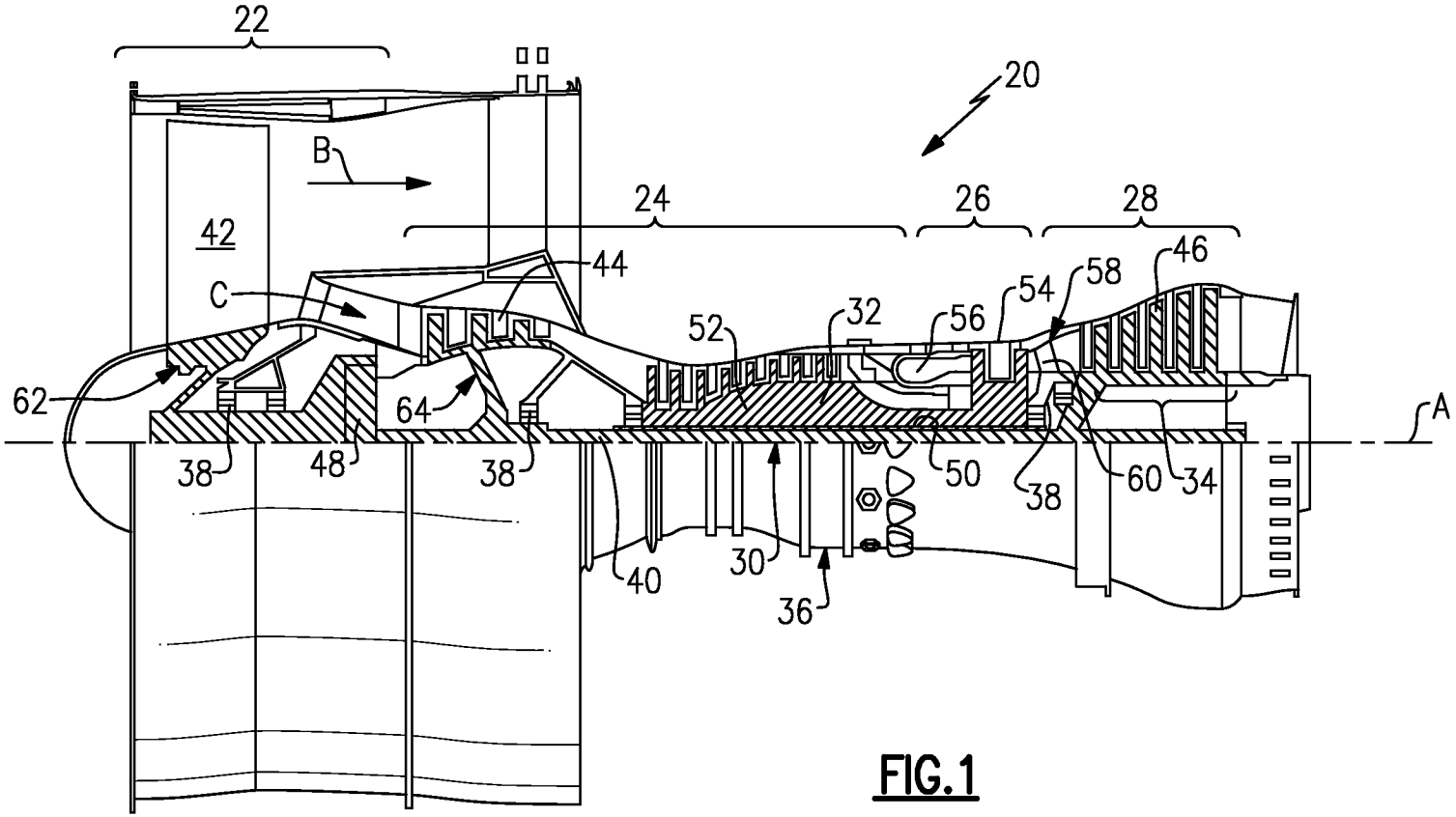
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

The example gas turbine 20 includes a fan hub 62 and a compressor hub 64. The fan hub 62 and the compressor hub 64 both include features for supporting airfoils that rotate about the engine axis A. In the example of the compressor hubs 64, a plurality of compressor blades are supported in the hub 64 to rotate and provide the desired compression of incoming air flow through the air flow paths C.

The fan hub 62 supports the plurality of fan blades 42 and also rotates about the engine axis A. In this example, the fan hub 62 is driven by the geared architecture 48 to rotate at a speed that is different than the low pressure turbine 46.

Figure 2:
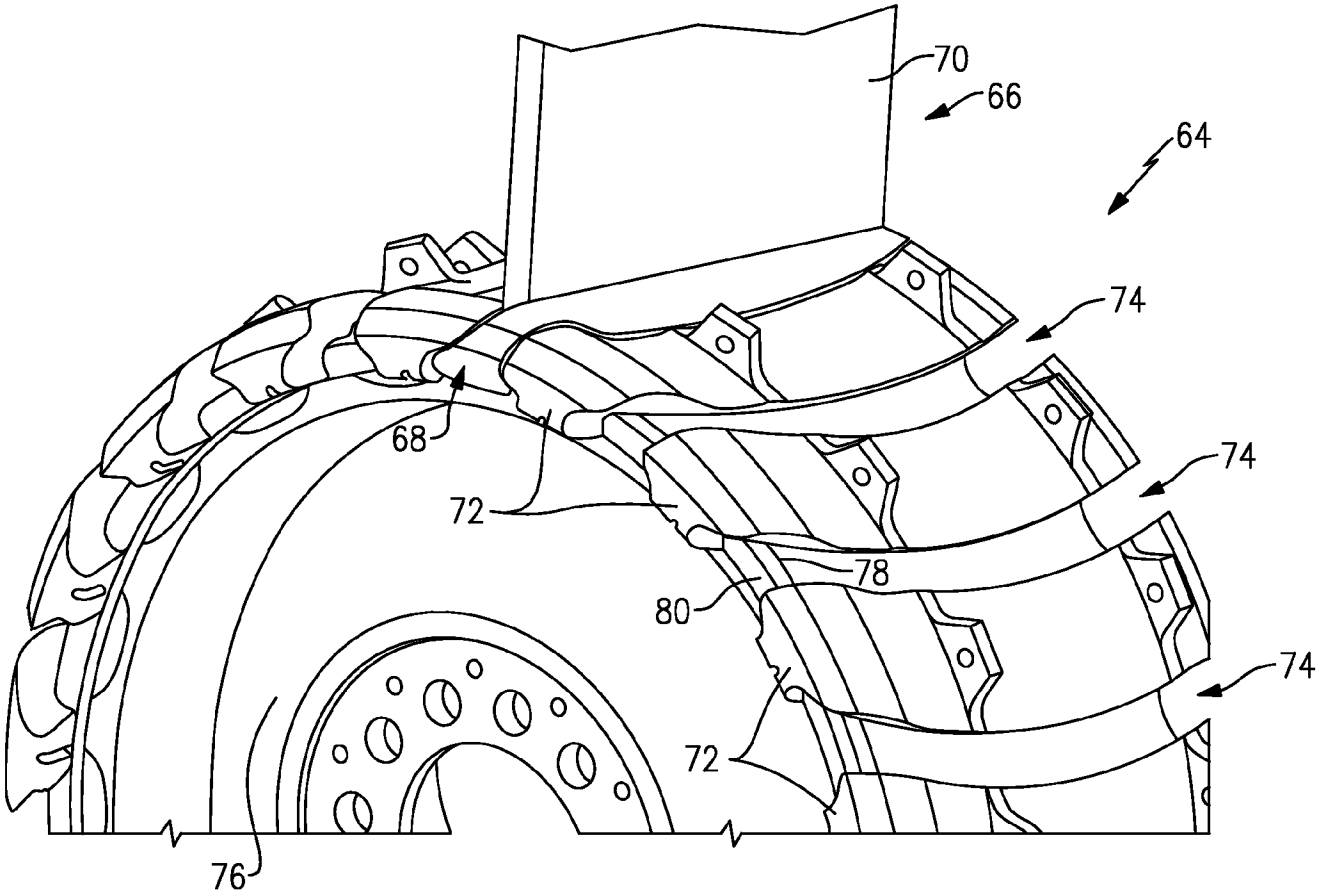
FIG. 2 is a schematic view of an example rotor hub.

Referring to FIG. 2, an example compressor hub 64 is schematically illustrated and supports a plurality of blades 66. The blades 66 each include an airfoil portion 70 and a root portion 68. The root portion 68 is received within one of a plurality of slots 74 defined within the rotor hub 64. The root portion 68 includes a shape that corresponds with a shape of the slots 74 to secure the blade 66 within the rotor hub 64.

Each of the blades 66 are slid within a corresponding slot 74 until abutting a stop defined within the slot 74. Retaining rings are utilized at a forward portion of the rotor hub 64 slots 74 to maintain the blade 66 within the corresponding slot 74. In this example, plurality of hooks 72 extend from the rotor hub 76 and are part of the slot 74 defined to receive the corresponding root portion 68.

Figure 4:
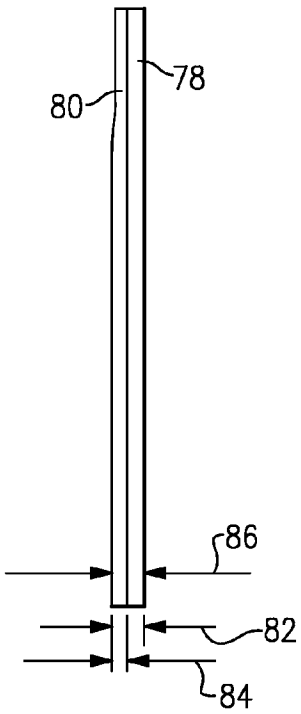
FIG. 4 is a side view of the example retaining ring assemblies.
Figure 3A:
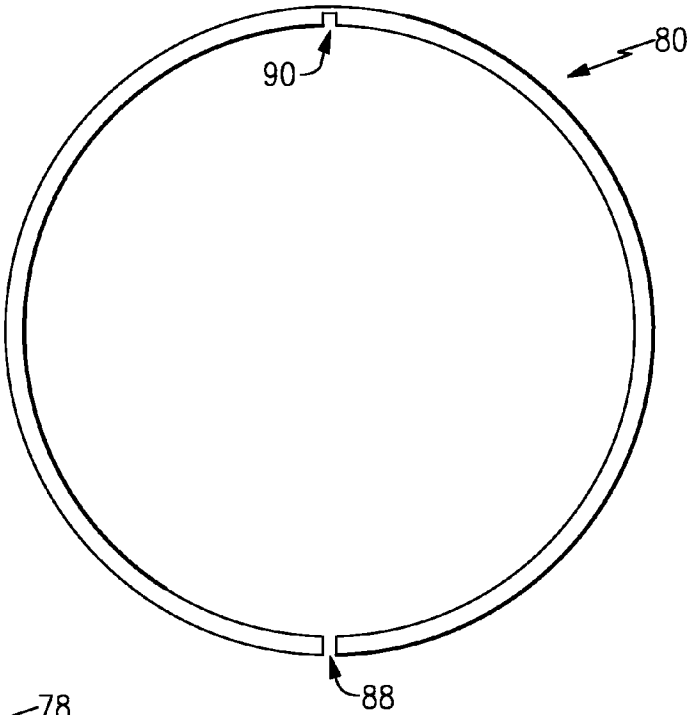
FIG. 3*a* is a plan view of one example retaining ring.
Figure 3B:
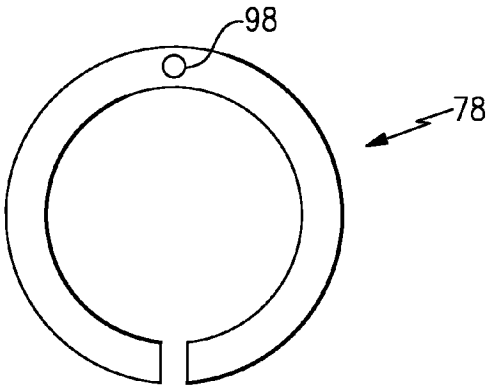
FIG. 3*b* is a plan view of another example retaining ring.

Referring to FIGS. 3*a*, 3*b* and 4 with continued reference to FIG. 2, the retaining rings 78, 80 include a split portion 88 that allows them to be compressed for assembly into an annular groove 96 defined within the rotor 64. The annular groove 96 is defined within the hooks 72 of the rotor 64. The use of a single retaining ring of a thickness required to maintain the blades 66 within the slot 74 can result in a stiffness that makes assembly of the retaining ring difficult. Accordingly, in this example assembly, a first retaining ring 78 and a second retaining ring 80 are utilized to provide the desired thickness and stiffness to maintain the blades 66 within the slots 74.

Instead of one thick retaining ring, first and second 78,80 retaining rings of smaller thicknesses are utilized to ease assembly. In this example, the first retaining ring 78 and the second retaining ring 80 are utilized and assembled within the same annular groove 96 defined within the hook 72 of the rotor 64. A desired total thickness 86 is provided by the combination of the first retaining ring 78 and the second retaining 80. Each of the first retaining rings includes a thickness 82, 84 that is less than the total desired thickness 86. In this example, each of the first and second retaining rings 78 and 80 include a common thickness 82 and 84. The reduced thickness of each of the retaining rings 78, 80 eases assembly such that the stiffness of each single retaining ring 78, 80 by itself are not of a magnitude that makes assembly difficult.

Each of the example retaining rings 78 and 80 includes a split 88 that allows the retaining ring 78, 80 to be compressed and assembled within the corresponding annular groove 96 defined in the hooks 72 of the rotor 64. The first retaining ring 78 includes an opening 98 receives a pin 94 for holding a position of both the first and second rings 78, 80. The example pin 94 includes a shoulder portion 95 that holds the pin 94 within the hooks 72 of the rotor 64.

Figure 5:
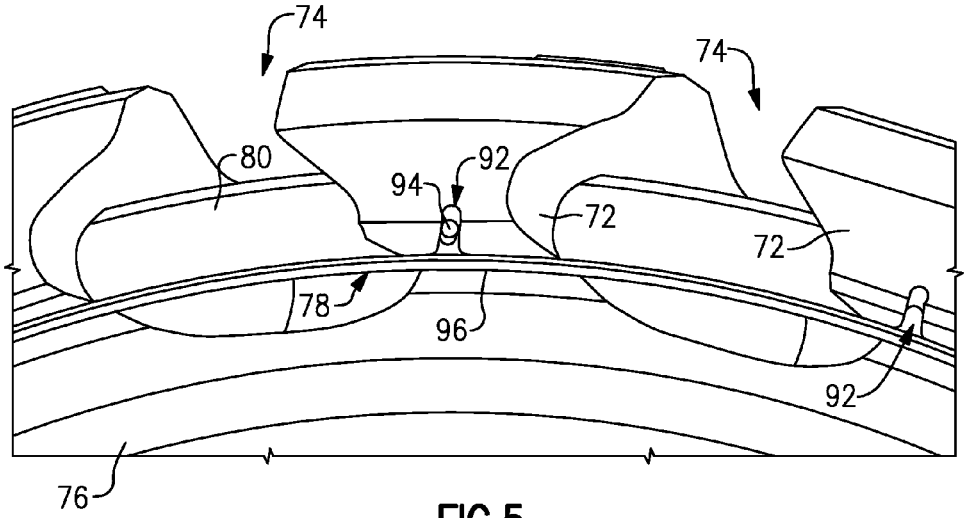
FIG. 5 is an enlarged view of the example retaining ring supported within the rotor.
Figure 6:
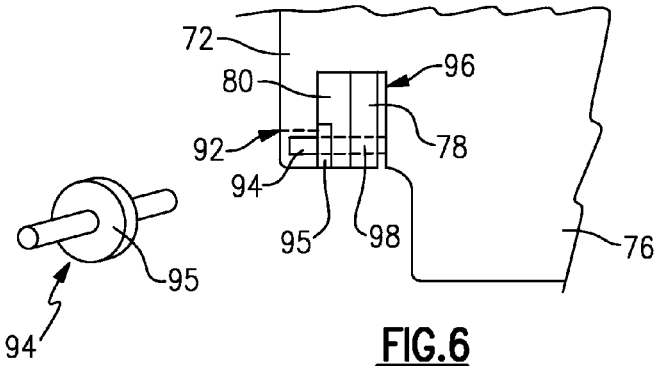
FIG. 6 is a cross-sectional view of the example retaining rings disposed within a rotor groove.

Referring to FIGS. 5 and 6 with continued reference to FIGS. 3*a*. 3*b* and 4, the example rotor 64 includes the hooks 72 that combine to define the annular groove 96 that receives the first and second retaining rings 78, 80. Each of the retaining rings 78, 80 is of a smaller thickness than a total desired thickness 86 (FIG. 4) and are received within the same annular groove 96. The annular groove 96 is of a width that is at least equal to the total thickness 86 of the combined first and second retaining rings 78, 80. The example annular groove 96 may also be slightly larger than the total thickness 86 to ease assembly.

The second retaining ring 80 includes a notch 90. The first retaining ring 78 includes the opening 98. The notch 90 and opening 98 corresponds with a notch 92 that is defined within a corresponding hook 72. The notch 92 in combination within the notch 90 and opening 98 provide for the circumferential orientation of each of the first and second retaining rings 78, 80. As appreciated, it is desired that the split 88 of each of the first and second retaining rings 78 and 80 are not aligned. Accordingly, the notch 90 can be aligned with a different notch 92 that is defined within the corresponding hook 72 to provide a misalignment of the split 88 in the corresponding first and second retaining rings 78, 80.

The pin 94 is inserted into hole 98 of the first retaining ring 78 and into the groove 96 while engaging the slot 92 radially. The pin 94 therefore maintains a circumferential position of each of the first and second retaining rings 78, 80 relative to each other.

In this example, the pin 94 is a round pin pressed into the ring 78 that fits through the notch 92 defined within the hook 72 and slot 90 defined within retaining ring 80. The pin 94 is received within the hole 98 with an interference fit. The interference is provided between the pin 94 and hole 98 within the ring 78 maintains the alignment pin 94 in place and also to maintain the desired circumferential orientation of the first retaining ring relative to the second retaining ring.

Figure 7:
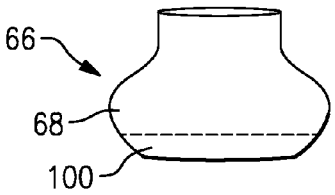
FIG. 7 is a schematic view of a portion of an example airfoil root portion.
Figure 8:
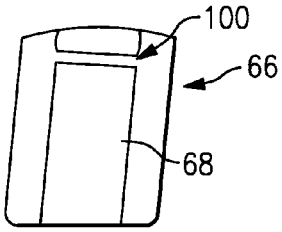
FIG. 8 is a bottom view of an example section for an airfoil.

Referring to FIGS. 7 and 8 with continued reference to FIG. 6, each of the example blades 66 include the root portion 68 that is received within corresponding slots 74. In one example, the blade 66 will include a corresponding groove 100 that aligns with the annular groove 96 defined within the hooks 72. The first and second retaining rings 78 and 80 will extend through the groove 100 defined within the blade 66 to maintain the blades 66 within the slots 74.

Figure 9:
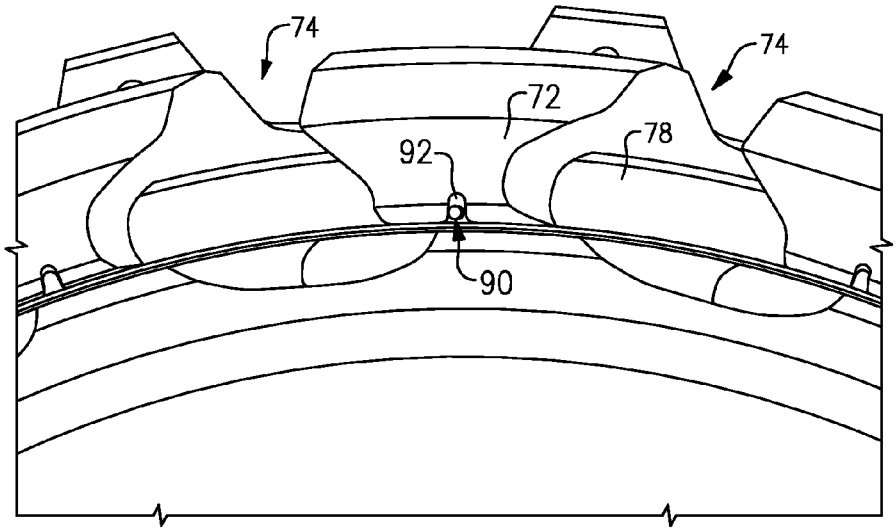
FIG. 9 is a schematic view of an initial assembly step for assembling the example retaining ring.
Figure 10:
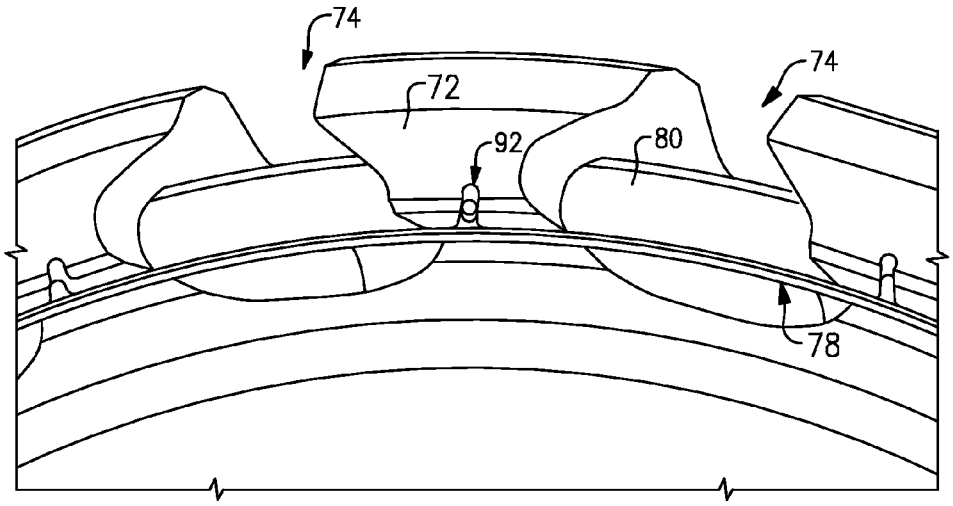
FIG. 10 is another figure illustrating a second assembly step for installing the example retaining rings.

Referring to FIGS. 9 and 10, the example retaining rings 78, 80 are assembled within the compressor hub 64 by first assembling the first retaining ring 78. Because the first retaining ring 78 is less than the total desired thickness, as a stiffness that allows it to be contracted or bent inwardly to clear each of the hooks 72 and be inserted within the annular groove 96. As appreciated, once the first retaining ring 78 is compressed so that it may clear hooks 72 it will spring back and conform and press against the outer surfaces of the annular groove 96 to maintain a desired fit therein.

Once the first retaining ring 78 is disposed within the annular groove 96, and pin 94 is pressed into the opening 98 and aligned with at least one of the notches 92 defined within the hook 72. The second retaining ring 80 is then inserted into the same annular groove 96 to abut the first retaining ring 80 while simultaneously aligning with the pin 94.

The combination of the first retaining ring 78 and the second retaining ring 80 provides the desired complete thickness 86 (FIG. 4) required to provide the stiffness to hold the blade 66 within the slot 74 of the rotor 64. The alignment pin 94 is press fit to maintain the relative position of the retaining rings 78, 80 to each other and to provide for a misalignment of the splits 88 of each retaining ring 78, 80.

As appreciated, although a compressor hub 64 is described by example in this disclosure, the example retaining ring assembly including the first and second retaining rings 78, 80 could be utilized throughout the gas turbine engine 20 where retaining rings are utilized to hold blades or airfoils within a rotating hub structure. Accordingly, the example retaining ring assembly could be utilized in the fan hub 62 or also in the turbine section 28 to hold turbine blades to rotating turbine rotors.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A rotor assembly comprising:

a plurality of blades including a root portion and an airfoil portion;

a rotor including a plurality of slots for receiving the root portion of the plurality of blades, wherein the rotor includes a rotor alignment slot and an annular groove;

a first retaining ring received within the annular groove;

a second retaining ring received within the annular groove against the first retaining ring, wherein each of the first retaining ring and the second retaining ring includes a split enabling each of the first retaining ring and the second retaining ring to be compressed, and an alignment slot for setting a circumferential orientation of the first and second retaining rings relative to the rotor; and a retaining pin received within the rotor alignment slot and the alignment slot defined within each of the first and second retaining rings for holding the retaining rings in the circumferential orientation.

2. The rotor assembly as recited in claim 1, wherein the first retaining ring is disposed aft of the second retaining ring in the same annular groove.

3. The rotor assembly as recited in claim 1, wherein the first retaining ring includes a first thickness, the second retaining ring includes a second thickness and the annular groove includes a width equal to or greater than the first thickness and the second thickness.

4. The rotor assembly as recited in claim 1, wherein the first and second retaining rings extend through the slots for receiving the plurality of roots.

5. The rotor assembly as recited in claim 1, wherein the rotor comprises a compressor rotor and the blades comprise compressor blades.

6. The rotor assembly as recited in claim 1, wherein the rotor comprises a fan hub and the blades comprise fan blades.

7. A rotor assembly comprising:

a plurality of blades including a root portion and an airfoil portion;

a rotor including a plurality of slots for receiving the root portion of the plurality of blades, wherein the rotor includes an annular groove;

a first retaining ring received within the annular groove;

a second retaining ring received within the annular groove against the first retaining ring, wherein the rotor includes a rotor alignment slot and each of the first and second retaining rings include alignment slots for setting a circumferential orientation of the first and second retaining rings relative to the rotor; and a retaining pin received within the rotor alignment slot and the alignment slots defined within the first and second retaining rings for holding the retaining rings in the circumferential orientation.

8. A gas turbine engine comprising:

a rotor rotatable about an engine axis, the rotor including a plurality of hooks defining slots for supporting blades on the rotor and an annular groove defined within the plurality of hooks;

a first retaining ring received within the annular groove;

a second retaining ring received within the annular groove and abutted against the first retaining ring, wherein each of the first retaining ring and the second retaining ring includes a split enabling each of the first retaining ring and the second retaining ring to be compressed;

an alignment slot transverse to the groove for circumferentially aligning the first and second retaining rings; and a retaining pin received within the alignment slot for holding the first and second retaining ring.

9. The gas turbine engine as recited in claim 8, including a plurality of blades received within the slots defined by the hooks, wherein each of the plurality of blades include a groove for receiving a portion of the first and second retaining rings.

10. The gas turbine engine as recited in claim 8, wherein the first retaining ring includes a first thickness and the second retaining ring includes a second thickness and the annular groove includes a width equal to or greater than the sum of the first thickness and the second thickness.

11. The gas turbine engine as recited in claim 8, wherein the rotor comprises a compressor rotor and the blades comprise compressor blades.

12. The gas turbine engine as recited in claim 8, wherein the rotor comprises a fan hub and the blades comprise fan blades.

13. A gas turbine engine comprising:

a rotor rotatable about an engine axis, the rotor including a plurality of hooks defining slots for supporting blades on the rotor and an annular groove defined within the plurality of hooks;

a first retaining ring received within the annular groove;

a second retaining ring received within the annular groove and abutted against the first retaining ring;

an alignment slot transverse to the groove for circumferentially aligning the first and second retaining rings; and a retaining pin received within the alignment slot for holding the first and second retaining rings.

* * * * *